US005392581A

United States Patent [19]

Hatzinikolas et al.

[11] Patent Number: 5,392,581

[45] Date of Patent: Feb. 28, 1995

[54] MASONRY CONNECTOR

[75] Inventors: Michael A. Hatzinikolas; Robert M. Pacholok, both of Edmonton, Canada

[73] Assignee: Fero Holdings Ltd., Edmonton, Canada

[21] Appl. No.: 148,865

[22] Filed: Nov. 8, 1993

[51] Int. Cl.[6] ..... E04B 1/38

[52] U.S. Cl. ..... 52/712; 52/379; 52/410

[58] Field of Search ..... 52/698, 712, 714, 418, 52/422, 424, 426, 431, 434, 579, 570, 379, 562, 565, 568

[56] References Cited

U.S. PATENT DOCUMENTS

| | | | |
|---|---|---|---|
| 3,353,312 | 11/1967 | Storch . | |
| 4,373,314 | 2/1983 | Allan . | |
| 4,843,776 | 7/1989 | Guignard | 52/434 |
| 4,869,038 | 9/1989 | Catani | 52/712 |
| 4,869,043 | 9/1989 | Hatzinikolas et al. | 52/379 X |
| 5,207,043 | 5/1993 | McGee et al. | 52/410 |

FOREIGN PATENT DOCUMENTS

| | | |
|---|---|---|
| 1294457 | 1/1992 | Canada . |
| 1306116 | 8/1992 | Canada . |

*Primary Examiner*—Carl D. Friedman
*Assistant Examiner*—Creighton Smith
*Attorney, Agent, or Firm*—Murray E. Thrift; Adrian D. Battison; Stanley G. Ade

[57] ABSTRACT

A masonry connector for a veneer wall has an outer coupling end for connection to a wall tie secured to the veneer. An inner anchoring end of the connector is secured to the back-up wall. Where the back-up wall is masonry wall, the anchoring portion includes a vertical plate, apertured to be keyed into the mortar between two side-by-side, adjacent blocks of the back-up wall, and a laterally projecting, corrugated flange to be keyed into the mortar between two vertically adjacent blocks. A rearwardly facing edge immediately in front of the anchoring end abuts against the outer face of the masonry wall to ensure the positioning of the connector at the proper depth. A low conductivity section of the connector between the coupling end and the anchoring end has a series of holes through it to minimize the thermal transfer along the connector.

7 Claims, 4 Drawing Sheets

MASONRY CONNECTOR

FIELD OF THE INVENTION

The present invention relates to a connector for use in a cavity wall, for tying a masonry veneer to a back-up wall.

BACKGROUND

In a cavity wall with a brick or other masonry veneer, the veneer is tied to a back-up wall using wall ties or connectors that extend across the wall cavity. The present invention relates to certain improvements in such connectors, including a novel arrangement for anchoring a connector to a masonry back-up wall and an improved arrangement for dealing with insulation between the veneer and the back-up wall.

SUMMARY

According to one aspect of the present invention there is provided a connector for a veneer wall having a masonry back-up wall composed of masonry blocks and mortar and a masonry veneer separated from the back-up wall by a cavity, said connector comprising:

an outer coupling end for connection to a wall tie secured to the veneer; and an inner anchoring end for securement to the back-up wall, the inner anchoring end including a vertical plate portion for engagement between two side-by-side blocks of the back-up wall and a laterally extending flange for engagement between two vertically adjacent blocks of the back-up wall.

It is preferred that the vertical plate part of the connector has a number of apertures through it and that the flange has lateral corrugations, both structures being for keying into the mortar of the back-up wall. The vertical plate and flange arrangement also ensures proper placement of the connector.

According to another aspect of the present invention there is provided a masonry connector for a cavity wall having a back-up wall and a brick veneer separated from the back-up wall by a cavity, the connector comprising a plate with an inner anchoring end for securement to the back-up wall, an outer coupling end for connection to a wall tie secured to the veneer, a low conductivity section between the anchoring end and the coupling end and a plurality of holes through the low conductivity section arranged to reduce heat transfer between the anchoring and coupling ends.

The connector may also be associated with an insulation support for supporting insulation placed against the back-up wall, in the cavity. The insulation support is preferably in the form of a rhombic plate, slotted to accommodate the outer end of the connector. Crossed slots in the plate allow its use with connectors of different sizes. The plate is held in place with the masonry tie extending through a slot at the end of the connector and into the mortar of the veneer.

Certain embodiments of the invention are described by way of example in the following. These are not to be considered limiting, as other embodiments of the invention are also possible.

BRIEF DESCRIPTION OF THE DRAWINGS

In the accompanying drawings, which illustrate exemplary embodiments of the present invention.

DETAILED DESCRIPTION

Figure 1:
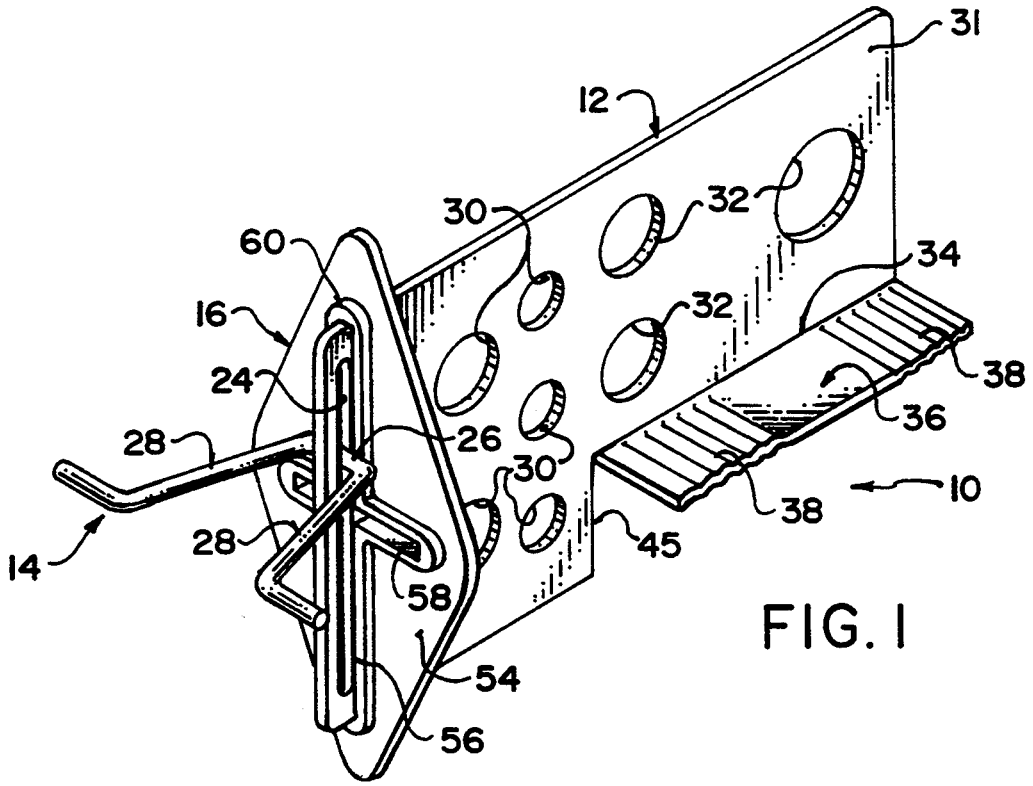
FIG. 1 is an isometric view of a first embodiment of the of the invention assembled with an insulation retainer and a masonry tie.
Figure 3:
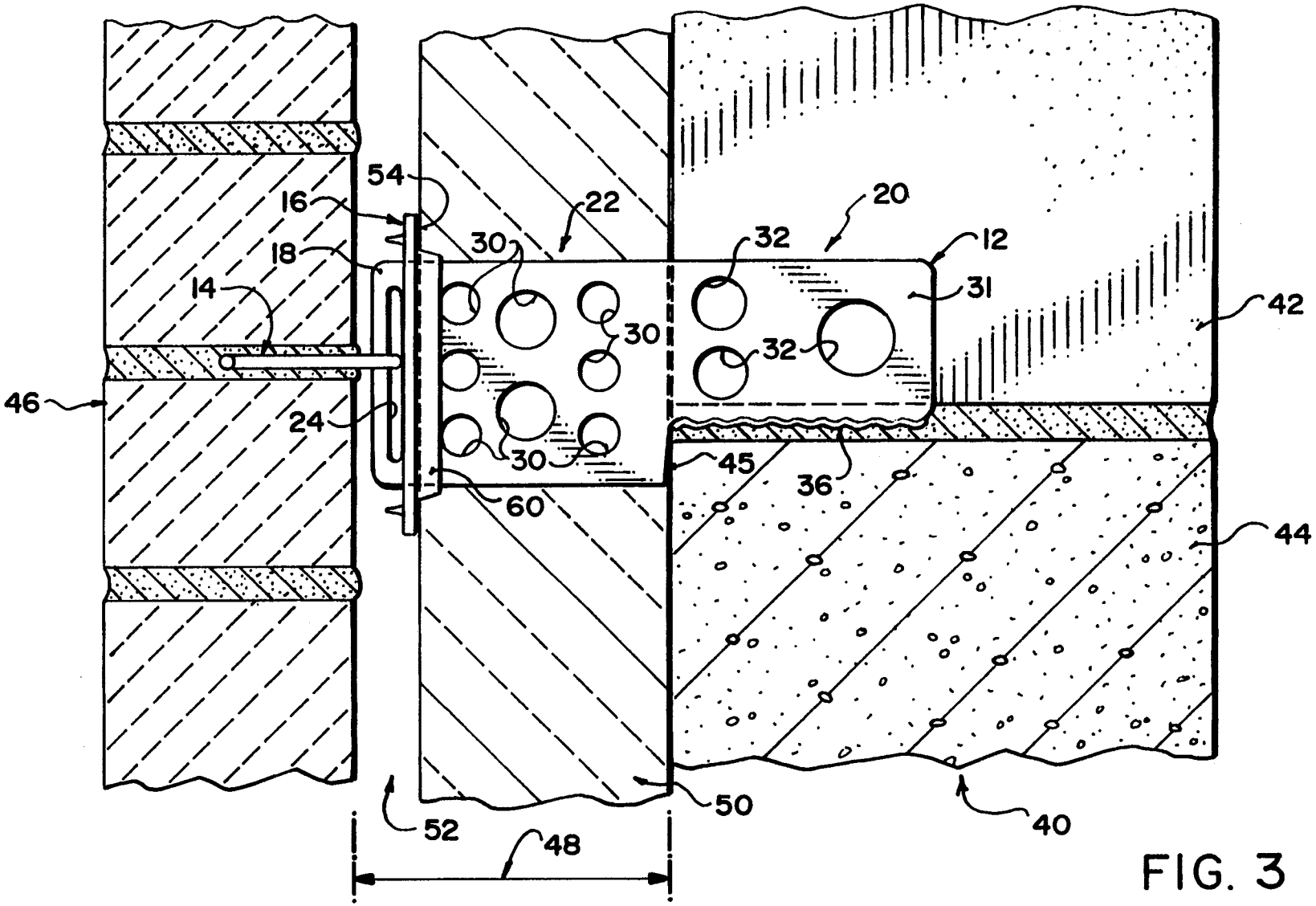
FIG. 3 is a side view of the assembly as shown in FIG. 1 in an installed state.

Referring to the accompanying drawings, especially to FIGS. 1 and 3, there is illustrated a connector assembly 10. This includes a connector 12, a masonry wall tie 14 coupled to the outer end of the connector and an insulation support 16.

Figure 2:
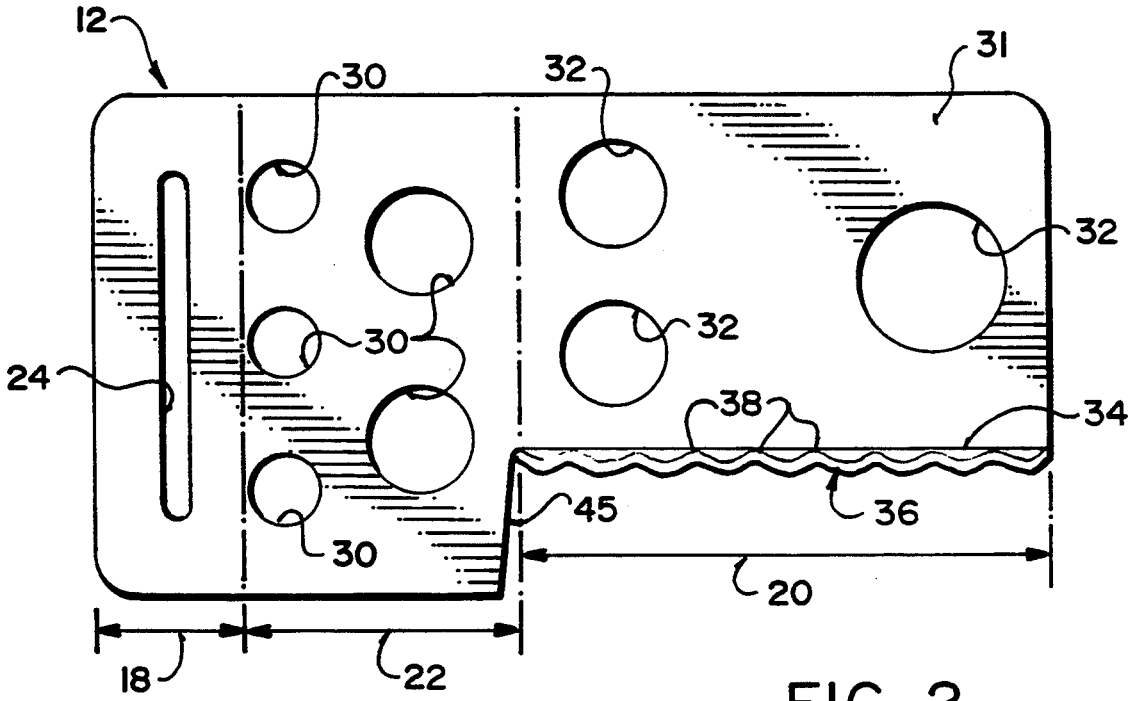
FIG. 2 is a side view of the connector in FIG. 1.

As illustrated most particularly in FIG. 2, the connector 12 is formed from a rectangular plate. It has an outer coupling end 18, an inner anchoring end 20 and a low conductivity section 22 between the coupling and anchoring ends 18 and 20. Along the outer coupling end is a slot 24. As illustrated most particularly in FIG. 1, the slot engages the bight 26 of the masonry wall fie 14. The two arms 28 of the wall tie diverge from the bight to be embedded in the mortar of the masonry veneer.

The low conductivity section 22 of the connector has a series of through holes 30 that interrupt the direct heat conduction path along the connector between the coupling and anchoring ends. This reduces the amount of heat transferred along the plate between the back-up wall and the veneer, through the cavity and any insulation in the cavity.

In the anchoring end 20, the connector is configured as a vertical plate 31 with a series of mortar holes 32. At the bottom of the plate is a fold line 34 where the lower section of the plate has been folded up to form a laterally extending flange 36. The flange is formed with lateral corrugations 38.

When the connector assembly 10 is installed as illustrated in FIG. 3, the inner anchoring end 20 is embedded in the mortar of a concrete block wall 40. The vertical plate 31 is located between two horizontally adjacent, side-by-side blocks. The holes 32 key into the mortar between these blocks. The flange 36 extends into the space between two vertically adjacent blocks 42 and 44 so that the corrugations in the flange will key into the mortar between those blocks. Immediately in front of the flange 36, the rear edge 45 of the lower part of the low conductivity section engages the face of the back-up wall.

This simple configuration ensures that the wall tie is properly positioned at all times. The rear edge 45 of the low conductivity section abutting the front of the lower block 44 locates the connector at the proper depth, while the vertical plate 31 and the flange 36 in the mortar between adjacent blocks serves to locate the connector laterally and vertically.

The wall tie 14 extends from the slot 24 into the mortar between two courses of the veneer wall 46. The cavity 48 between the veneer 46 and the back-up wall 40 is partially filled with insulation 50 and partially with an air gap 52 between the insulation and the veneer. To retain the insulation against the back-up wall, the connector is fitted with the insulation support 16. This includes a rhombic plate 54 (FIG. 1) with two diametral slots 56 and 58. As illustrated most particularly in FIG. 1, ribs 60 surround the slots 56 and 58 for reinforcement purposes. The slots 56 and 58 are of different lengths to accommodate connectors of different sizes. The coupling end 18 of the connector is passed through the slot 56. When the wall tie 14 is installed through the slot 24, the insulation support is held in place against the insulation.

In the installed arrangement of FIG. 3, the insulation support is reversed from the arrangement illustrated in FIG. 1 so that the ribs engage the insulation.

Figure 4:
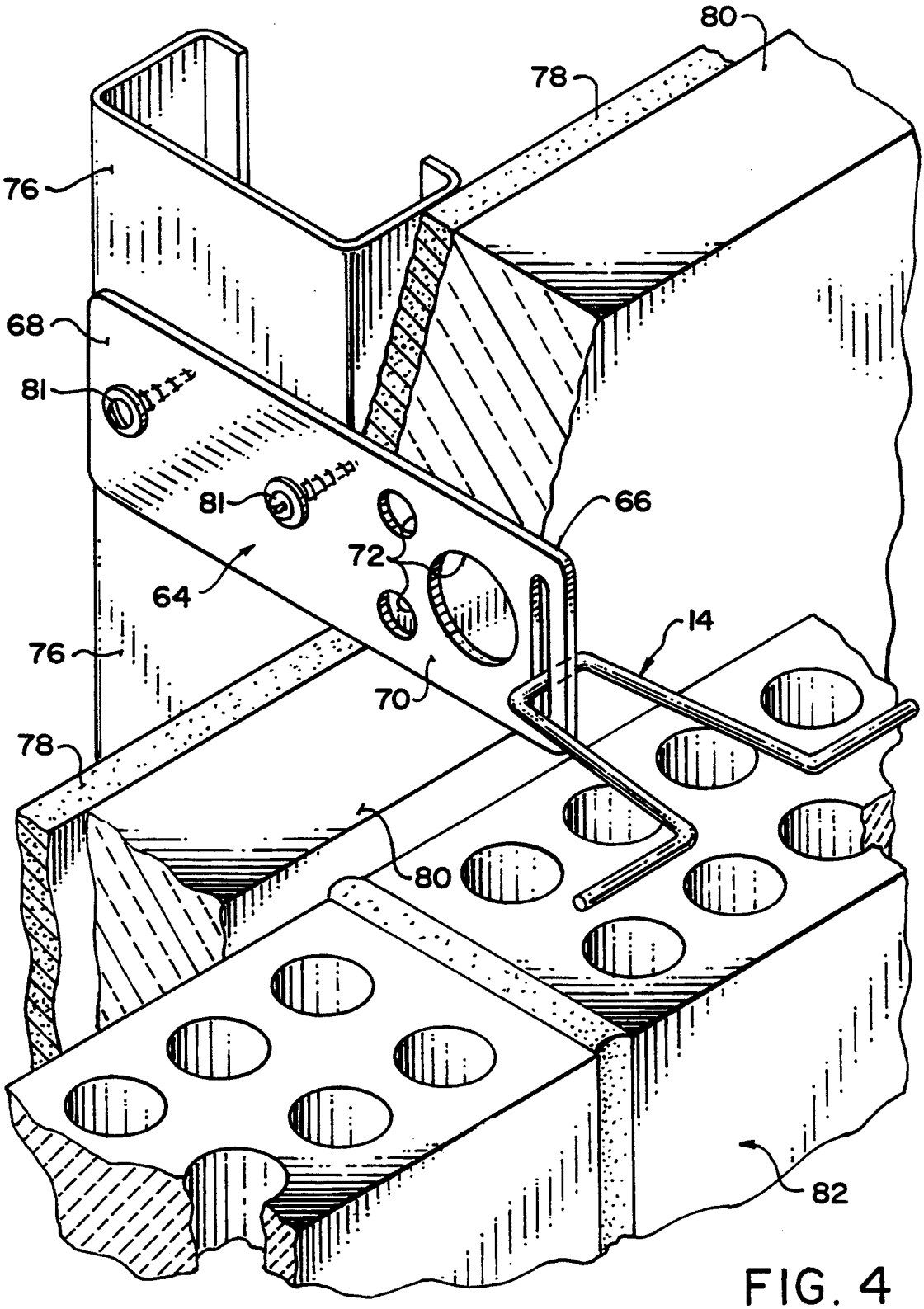
FIG. 4 is an isometric of an alternative embodiment of the invention in an installed condition.

Turning now to FIG. 4, there is illustrated a connector 64 with a coupling end 66, an anchoring end 68 and a low conductivity section 70 between the two ends. The low conductivity section has a series of holes 72 to minimize heat transmission through that section of the connector. This connector is intended to be used with a metal stud back-up wall including stud 76 and surface paneling 78. The connector passes through the surface panel and the insulation 80. It is connected to the stud 76 of the stud wall by sheet metal screws 81 and to the veneer 82 by wall tie 14.

Figure 5:
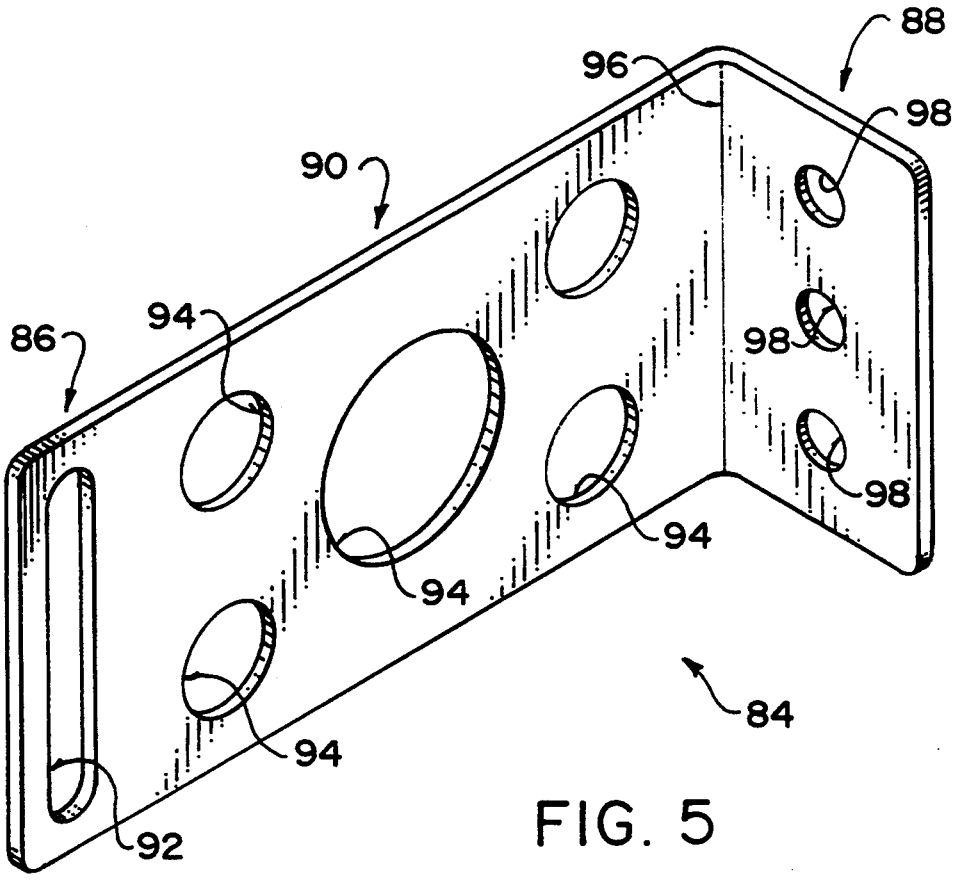
FIG. 5 is an isometric view of a third embodiment of the invention.

A third embodiment of the connector is illustrated in FIG. 5. In this embodiment, the connector 84 has a coupling end 86, an anchoring end 88 and a low conductivity section 90 between the two. The coupling end has a slot 92 to accommodate a wall tie 14. The low conductivity section has a series of holes 94 to minimize the thermal transmission along the connector. At the inner end of the low conductivity section is a fold line 96, where the anchoring end 88 is folded over as a laterally projecting, vertical flange. A series of mounting holes 98 are used to receive fasteners for mounting the connector on a back-up wall of the appropriate son.

While particular embodiments of the invention have been described in the foregoing, it is to be understood that other embodiments are possible within the scope of the invention. The invention is to considered limited solely by the scope of the appended claims.

We claim:

1. A connector for a veneer wall having a masonry back-up wall composed of masonry blocks and mortar and a masonry veneer separated from the back-up wall by a cavity, said connector comprising:

an outer coupling end for connection to a wall tie secured to the veneer; and an inner anchoring end for securement to the back-up wall, including a vertical plate portion for engagement between two side-by-side blocks of the back-up wall and a laterally extending flange for engagement between two vertically adjacent blocks of the back-up wall and laterally extending corrugations in the flange for keying into mortar between the two vertically adjacent blocks.

2. A connector according to claim 1 including apertures in the vertical plate portion for keying into mortar between the side-by-side blocks.

3. A connector according to claim 2 wherein the outer coupling end further comprises a substantially vertical slot extending along the connector for engagement with the wall tie.

4. A connector according to claim 1 wherein the connector further includes a low conductivity section between the outer coupling end and the inner anchoring end.

5. A connector according to claim 4 including a plurality of holes through the low conductivity section.

6. A connector according to claim 5 further including an insulation support plate having at least one slot therethrough for receiving the outer coupling end of the connector.

7. A connector according to claim 6 wherein the insulation support plate is rhombic.

* * * * *